US007228801B2

(12) United States Patent
Dunnam et al.

(10) Patent No.: US 7,228,801 B2
(45) Date of Patent: Jun. 12, 2007

(54) BALLISTIC TRACER PLATFORM FOR SHOTGUN AMMUNITION

(76) Inventors: James Alfred Dunnam, 2 Candlespice Pl., The Woodlands, TX (US) 77382; Mauricio F. Quintana, 58 W. Sienna Pl., The Woodlands, TX (US) 77382

( * ) Notice: Subject to any disclaimer, the term of this patent is extended or adjusted under 35 U.S.C. 154(b) by 0 days.

(21) Appl. No.: 10/656,471

(22) Filed: Sep. 5, 2003

(65) Prior Publication Data

US 2005/0056184 A1 Mar. 17, 2005

(51) Int. Cl.
*F42B 12/38* (2006.01)

(52) U.S. Cl. ..... 102/458

(58) Field of Classification Search ..... 102/448, 102/449, 457, 458, 459
See application file for complete search history.

(56) References Cited

U.S. PATENT DOCUMENTS

| | | | | | |
|---|---|---|---|---|---|
| 1,457,337 | A * | 6/1923 | Barrows | 102/458 |
| 1,864,916 | A * | 6/1932 | Gachassin-Lafite | 102/449 |
| 1,887,989 | A * | 11/1932 | Nimmo | 102/458 |
| 1,887,990 | A * | 11/1932 | Brownsdon et al. | 102/458 |
| 3,262,390 | A * | 7/1966 | Cowles et al. | 102/458 |
| 3,405,638 | A | 10/1968 | Stoner, Jr. | |
| 3,760,735 | A | 9/1973 | Schmitt | |
| 4,080,899 | A | 3/1978 | Luban | |
| 4,167,904 | A * | 9/1979 | Ferri | 102/452 |
| 4,389,939 | A | 6/1983 | Ofuji | |
| 4,553,481 | A | 11/1985 | Ricci | |
| 4,841,866 | A | 6/1989 | Miesner | |
| 5,429,054 | A | 7/1995 | Topping | |
| 6,428,007 | B2 * | 8/2002 | Skeuse et al. | 273/363 |
| 6,539,873 | B2 | 4/2003 | Diller | |
| 6,694,887 | B2 * | 2/2004 | Diller | 102/458 |

FOREIGN PATENT DOCUMENTS

| | | |
|---|---|---|
| EP | 0555107 | * 8/1993 |
| FR | 2598213 | * 11/1987 |
| FR | 2685466 | * 6/1993 |
| WO | WO 94/23264 | * 10/1994 |

* cited by examiner

*Primary Examiner*—David Parsley
(74) *Attorney, Agent, or Firm*—Mary J. Gaskin

(57) ABSTRACT

A ballistic tracer platform for use with a shotgun shell to provide an aiming and training aid for shotgun shooting sports, which also can be used for military and police applications. The ballistic tracer platform carries a tracer element, which provides the shooter with a consistent reference to make corrections to his or her aiming point and shooting techniques. The ballistic tracer platform can be used in ordinary shotgun shells. The ballistic tracer platform consists of a cylindrical structure with a coaxial cylindrical cavity in which the tracer element is disposed. The tracer element can be composed of incendiary or non-incendiary materials. The ballistic tracer platform can be modified to improve its ballistic shape, such as modifying the shape of its nose. Mass can be added to cavities formed in the ballistic tracer platform in order to adjust the weight of the device. Grooves, fins, or orifices can be formed in surface of the device to create additional spin.

26 Claims, 4 Drawing Sheets

BALLISTIC TRACER PLATFORM FOR SHOTGUN AMMUNITION

FIELD OF THE INVENTION

The present invention relates to shotgun ammunition, more specifically tracers used to make the shot visible to shooters.

BACKGROUND OF THE INVENTION

Shotgun sports date back to the late 1700's with the introduction of trap shooting of live pigeons. The sport later evolved with the introduction of clay pigeons in 1880 and the development of reliable clay throwing machines in 1890. The two main types of shotgunning games that evolved are Trap and Skeet. Trap is a game where the clays are thrown from a single location or house, at different random angles while the shooters rotate between five shooting positions. Skeet is a game where clays are thrown from two locations or houses, at consistent trajectories while shooters rotate between eight stations. International trap was introduced as an Olympic Sport in 1952, while International Skeet was introduced as an Olympic Sport in 1968. In Sporting Clays, a third shotgunning game which has been introduced in recent years, clays are thrown from many locations in an attempt to resemble a real life hunt, while shooters walk through a golf course-like field.

All shotgun sports require the shooter to accurately predict the trajectory of the target. This requires a good understanding of the physics involved, including the speed of the shot and target, the trajectory of the shot and target, the type of shot and the size of the target. To complicate things, shooters need to develop the ability to predict the position of the target and aim their weapons appropriately so that the shot intersects the target. This drives the need to shoot the clay by leading it. The lead is defined as the distance in front of the target, which the shooter aims and shoots at in order to break the target. This lead will vary depending on the game, targer speed, shot type, shot speed, shooters technique, and atmospheric conditions; it can range from a few inches to more than ten feet.

The greatest challenge in shotgunning sports is mastering the lead. The supersonic nature of the shot, with speeds ranging from approximately 1100 to 1400 ft/s (335 to 427 m/s), and the speed of the target, ranging from approximately 40 to 70 miles/h (64 to 112 Km/h), make it almost impossible for the shooter to know where his shot should go relative to the target. To further complicate accurate aiming, the human brain and eye refresh images approximately every 0.1 seconds, while the average shot flight time to the target is approximately 0.05 seconds. This makes the game a real challenge to learn, and very difficult and time-consuming to master.

The visibility of an object to the human eye generally depends on the size of the object, the relative distance between the object and the observer, the relative speed of the object, the color of the object, and the light intensity and atmospheric conditions. Inventors have developed tracers for shotgun shells in an attempt to aid the shooter in visualizing his or her shot with regard to the target.

Prior tracers can be categorized as non-ignition and ignition type. Non-ignition type inventions have been unsuccessful in the shooters market; they include:

(a) Pellet with fluorescent tails (U.S. Pat. No. 3,760,735 to P. F. Schmitt in 1971);

(b) Shot encapsulated with light reflective coating (U.S. Pat. No. 4,080,899 to W. L. Luban in 1978);

(c) Chemiluminescent tracer that accompanies the shot (U.S. Pat. No. 4,553,481 to V. Ricci in 1984); and (d) Shotgun shell flight path indicator (U.S. Pat. No. 6,539,873 to E. W. Diller in 2003).

Ignition type inventions although promising have had very limited success in the market place, these include:

(a) Single bullet-shaped tracer projectile with pyrotechnic mixture in the trailing end (U.S. Pat. No. 3,405,638 to J. A. Stoner in 1968);

(b) Shot pellets coated with ignitable illuminant or smoking agent (U.S. Pat. No. 4,389,939 to H. Ofuji in 1983);

(c) Single ball-shaped tracer projectile with pyrotechnic mixture in the trailing end (U.S. Pat. No. 4,841,866 to D. W. Miesner in 1989); and (d) Tracer cartridges (U.S. Pat. No. 5,429,054 to R. E. Topping in 1995).

The ignition type designs available today are mostly derived from U.S. Pat. No. 3,406,648 and U.S. Pat. No. 4,841,866. The marginal success of these inventions can be attributed to the high price charged and the clear fact that these inventions do not function properly. Currently available tracers, while visible, do not provide the shooter with a consistent reference to improve his or her shooting. Typical reasons tracers fail include the following:

(a) The tracer does not have a flight pattern consistent with that of the shot and therefore fails to provide the shooter with an appropriate reference.

(b) The tracer fails to ignite consistently because the pyrotechnic material does not have enough time and surface area to absorb heat from the propellant blast as it separates from the shot cup.

(c) Current tracer inventions have limited, if any, applicability to smaller shotgun gauges because of the geometric constraints in the smaller gauges like 16, 20, 28, and 410.

More specifically, currently available tracers fail because the tracer projectile travels randomly with the shot pattern. Manufacturers claim that the tracer projectile travels in the middle of the shot pattern, but field tests prove otherwise. The point of impact at 22 yards of currently available tracer projectiles is no more predictable than any single pellet within the shot. Field tests indicate that currently available tracers provide 30 to 40 inch groups from the point of aim, even though shotgun sports require a 12 inch group, or better, to be effective. The inaccuracy of current tracer designs stems from the fact that the tracer projectile is located at the bottom of the shot cup. Once fired, the tracer is subjected to the chaotic behavior and interference of the supersonic gases, shot and wad as it leaves the barrel and travels to the target. These interferences present the greatest challenge in designing an effective shotgun tracer. An improved tracer design should address these interferences and should still be capable of carrying the proper amount of shot within the constraints of standard shotgun cartridges.

SUMMARY OF THE INVENTION

The present invention provides a ballistic tracer platform for a tracer projectile which, when loaded into a shotgun shell, can be used to provide a shooter with a consistent reference, allowing him or her to make appropriate corrections to his or her shooting technique. This invention serves as a training aid to improve a shooter's accuracy for shotgun sports such as Trap, Skeet, or Sporting Clays. It also serves as a shotgun aiming and training aid for hunters, as well as having combat applications for military and police personnel. The invention enables the shooter to visualize the shot with respect to the target by firing the tracer ammunition in a manner identical to that of standard ammunition. The invention described herein can be modified and adjusted for use with all shot types, and it can be used in all shotgun gauges, including 4, 8, 10, 12, 16, 20, 28, and 410, in both single and double barrel shotguns.

In accordance with the present invention a shotgun tracer shell comprises a tracer platform with a ballistic coefficient equivalent to that of the shot pellets with which it is used. The platform has a coaxial cylindrical cavity to accommodate the tracer material as an integral part of the platform and to allow hot gases to ignite the pyrotechnic material. Helical grooves may be added to the platform surface to spin the tracer platform as it leaves the barrel and travels towards the target. The diameter, length, weight and shape of the tracer platform can be modified to match the flight characteristics of each particular shotgun gauge, shot type, and speed. Finally, the tracer platform has a coaxial cavity that acts as a gas seal to propel the shot.

The ballistic tracer platform can be manufactured from readily available materials using standard high volume processes, including injection molding or screw machines. The simplicity of the invention will enable effective and efficient quality control procedures in the manufacturing process.

Alternatively, the ballistic tracer platform can be manufactured with an integrated shot cup which separates as soon as the platform leaves the shotgun barrel, without interfering with the trajectory of the shot and tracer platform.

The ballistic tracer platform is used to carry a tracer element, which can be made from either incendiary or non-incendiary tracer material. The material used to make the tracer element can be pyrotechnic, electrical, chemiluminescent, or reflective. An optional fire suppressant can be included with the pyrotechnic material to reduce potential fire hazards.

It is an object of the present invention to provide a platform for a tracer projectile so that the projectile has an accurate, predictable, and centered trajectory to the shot string, without interference from the shot's trajectory.

Another object of the present invention is to provide means by which the tracer projectile can ignite more consistently by allowing the expanding gases more time and surface area to ignite the pyrotechnic material.

Yet another object of the present invention is to provide a tracer platform which can be adjusted to match the flight characteristics of each particular shotgun gauge, shot type, and speed.

Still another object of the present invention is to provide a tracer platform which is safe to use.

A further object of the present invention is to provide a tracer platform which is inexpensive and easy to produce.

Further objects and advantages of this invention will become apparent from a consideration of the drawings and description, infra.

DESCRIPTION OF THE PREFERRED EMBODIMENT

The present invention is designed to be used with a typical shotgun shell 1, which generally has a hull 2 with a metal base cap 3 and a crimped top 4.

Figure 1:
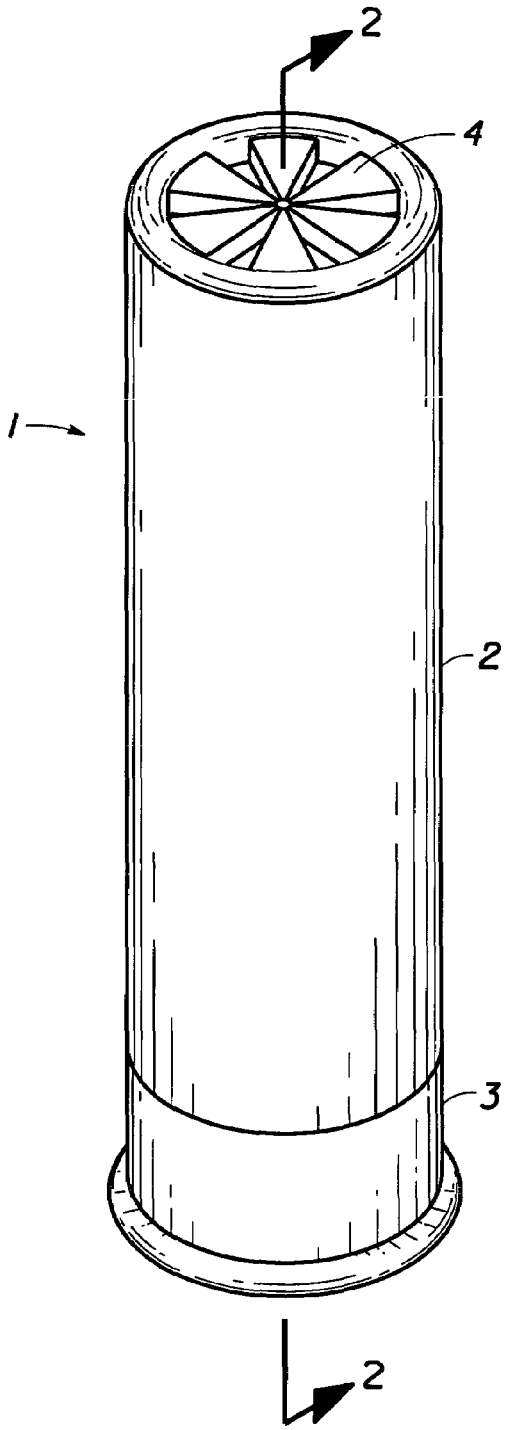
FIG. 1 is an isometric view of a shotgun shell contacting the ballistic tracer platform of the present invention.
Figure 2:
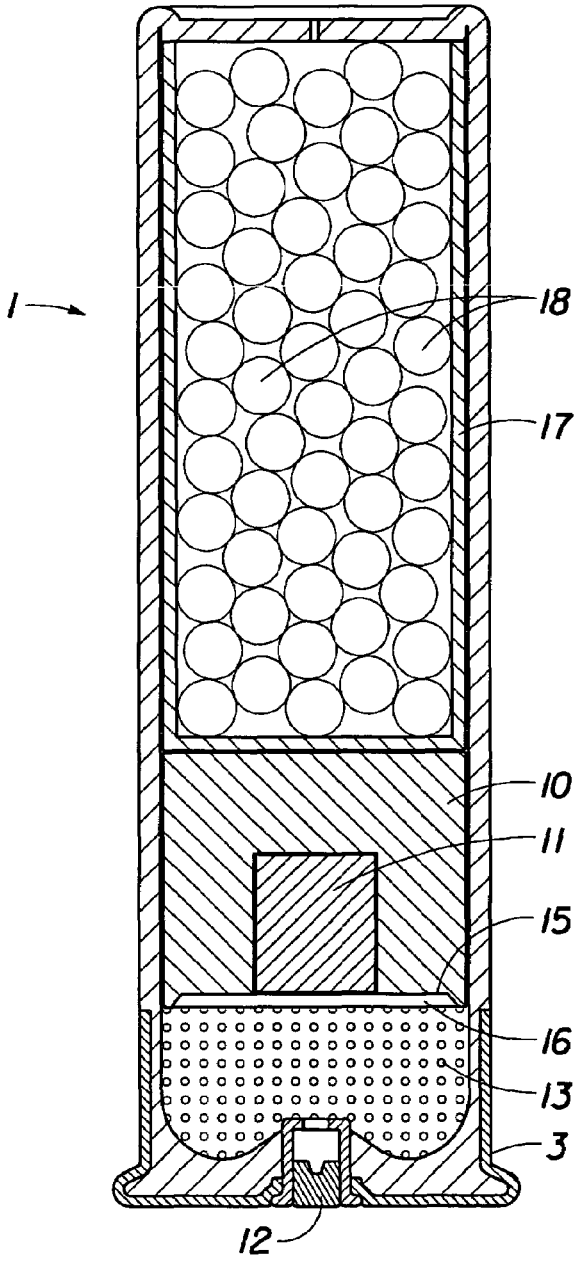
FIG. 2 is a sectional side view of the shotgun shell containing the ballistic tracer platform illustrated in FIG. 1 taken along line 2—2.

The sectional view in FIG. 2 shows a shotgun shell 1 which has been assembled with the cylindrical ballistic tracer platform 10 holding the tracer element 11 within its coaxial cylindrical cavity. Inside the base cap 3 is the primer 12, which ignites the propellant 13 contained in the bottom end of the shotgun shell 1. The bottom 15 of the ballistic tracer platform 10 is formed to create a gas seal cavity 16 between the ballistic tracer platform 10 and the propellant 13, allowing the gases to expand and the pyrotechnic mixture contained in the tracer element 11 to ignite. Above the ballistic tracer platform 10 is the shot cup 17 (or shot holder), which has been filled with shot pellets 18.

Figure 3:
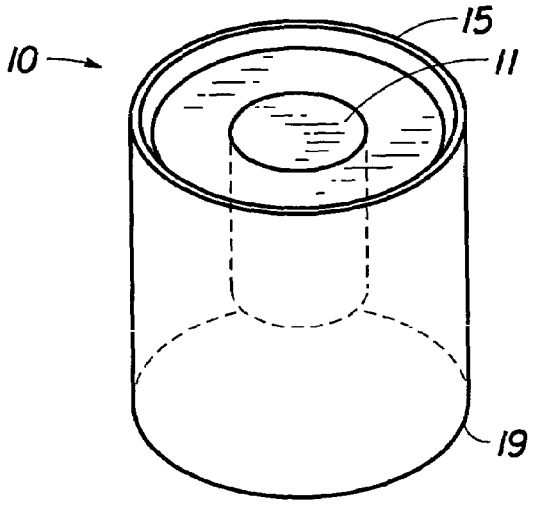
FIG. 3 is an isometric view of the ballistic tracer platform holding the tracer element, which is shown by the broken lines.

FIG. 3 shows a typical cylindrical ballistic tracer platform 10 holding the tracer element 11 in its cylindrical coaxial cavity. The ballistic tracer platform 10 is shown "upside-down" so that the contours of the concave-shaped bottom 15, can be more easily seen. The ballistic tracer platform 10 has a nose 19, which can be flat, as shown, or shaped to alter the ballistic properties of the ballistic tracer platform 10. The ballistic tracer platform 10 can be adjusted in size, shape, and materials used, depending on the shotgun gauge used; it can perform with different applications and shot types. The ballistic tracer platform 10 can be made with a diameter ranging from 0.2 inches to 1.25 inches, depending on the bore size for the shotgun in which it will be used; it can be used in all shotgun gauges, including 4, 8, 10, 12, 16, 20, 28, and 410, in both single and double barrel shotguns. The ballistic tracer platform 10 is made from a resilient material that can withstand the high pressures from expanding gases and compression forces. Examples of such materials include aluminum, brass, lead, neoprene, nylon, polyethylene, polyurethane, rubber, steel, polytetrafluoroethylene (known as Teflon®), and titanium; other metals and plastics may be used. The ballistic tracer platform 10 can be made by injection molding or turning processes as in screw machines. The ballistic tracer platform 10 can be introduced into standard shotgun shells by using existing loading processes. Alternatively, if a re-loader or hobbyist wishes to use a standard shot shell hand-loading process, he could substitute the ballistic tracer platform 10 for currently-available wad and gas seal elements.

The tracer element 11 is held within a cavity in the ballistic tracer platform 10 by gluing or interference fitting; alternatively, it can formed within the ballistic tracer platform 10 during the manufacturing thereof. In one embodiment, the tracer element 11 consists of a housing holding pyrotechnic material. Different types and colors of pyrotechnic material can be used. A fire suppressant can be included in the pyrotechnic device to reduce fire hazards. In another embodiment, the tracer element 11 can be incendiary materials which are heat-activated. In other embodiments, the tracer element 11 may be an electrical material (such as a light-emitting diode), a reflective material, or a chemiluminescent material. The size of the tracer element 11 can be adjusted to improve the visibility of the tracer and the duration of its luminescence.

Figure 4:
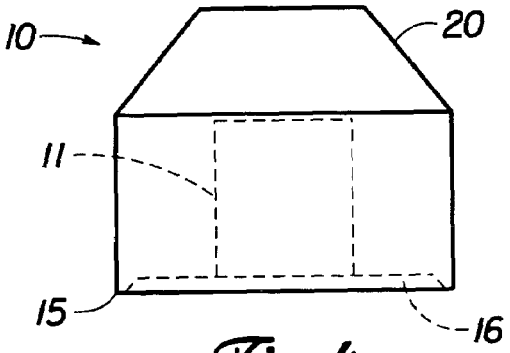
FIG. 4 is a side view of the ballistic tracer platform with a modified cone-shaped nose for improved ballistic performance.

As shown in FIG. 4, an alternate embodiment of the ballistic tracer platform 10 has a flat-conical nose 20 to improve its ballistic performance. Alternatively, the nose 20 could be spherical or conical in shape. The bottom 15 having a cavity forming the gas seal cavity 16, can be shaped to improve the seal from expanding gases at different pressures, depending on the type and volume of propellant and shot being used.

Figure 5:
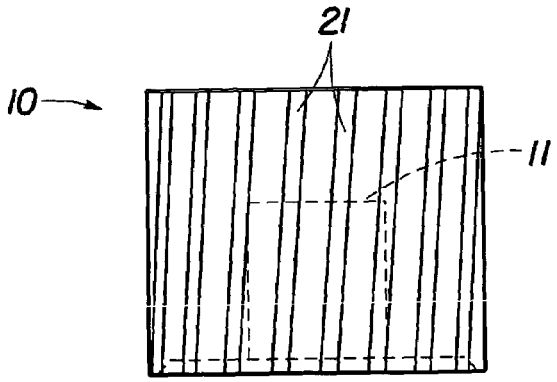
FIG. 5 is a side view of the ballistic tracer platform modified by forming helical grooves on its outer surface to add spin.

FIG. 5 shows a ballistic tracer platform 10 with helical grooves 21 (different shapes and angles can also be used) formed on its surface to add spin to the ballistic tracer platform 10.

Figure 6:
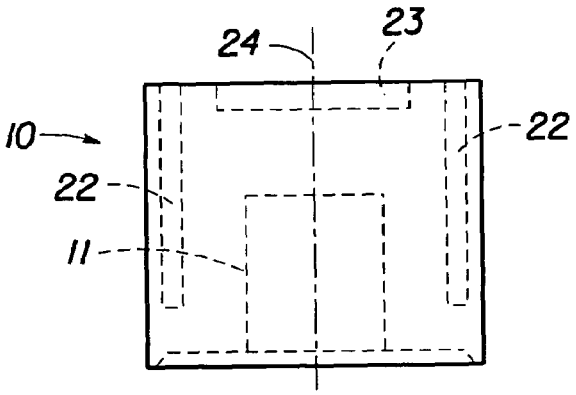
FIG. 6 is a side view of the ballistic tracer platform modified by the addition of symmetrically-spaced cavities, which can be filled in order to change the weight of the platform.

FIG. 6 shows a ballistic tracer platform 10 with cavities 22 and a top cavity 23, to which can be added materials having densities different from that of the ballistic tracer platform 10 itself. The cavities 22, 23, which must be located symmetrical to the longitudinal axis or centerline 24, allow the shooter to adjust the weight and flight characteristics of the ballistic tracer platform 10. The number, size, shape, and placement of the cavities 22, 23 used will depend on the size of the ballistic tracer platform 10 and its application.

Other embodiments of the ballistic tracer platform 10 could be made. For instance, the ballistic tracer platform 10 could be made with fins. Small indentations can be made on its surface to reduce air drag. Orifices can be formed on its surface to create additional spin of the ballistic tracer platform 10. A shot cup could be manufactured as an integral of the ballistic tracer platform 10, designed to separate once the ballistic tracer platform 10 leaves the barrel of the shotgun, without interfering with the trajectory of the shot and ballistic tracer platform 10.

FIGS. 7A–7D show the movement of the ballistic tracer platform 10, before and after ignition.

Figure 7A:
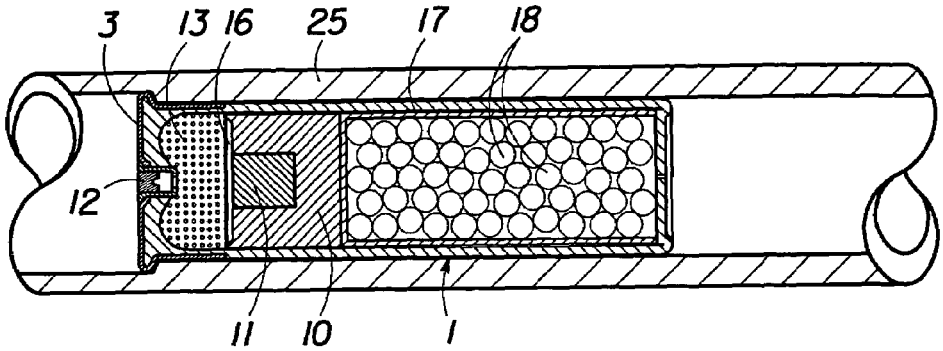
FIGS. 7A–7D are sectional side views showing the positions of the ballistic tracer platform before and after ignition.

In FIG. 7A, the shotgun shell 1, containing a shot cup 17 with shot pellets 18, has been loaded into the shotgun barrel 25. The primer 12 ignites the propellant 13, and gasses expand into the gas seal cavity 16, igniting the tracer element 11 in the ballistic tracer platform 10.

Figure 7B:
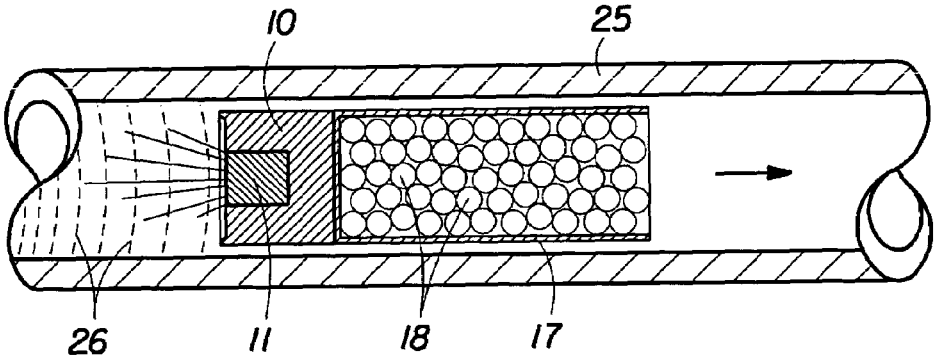

In FIG. 7B, the expanding gases 26 of ignition propel the shot cup 17 with shot pellets 18, and the ballistic tracer platform 10 holding the tracer element 11, through the shotgun barrel 25.

Figure 7C:
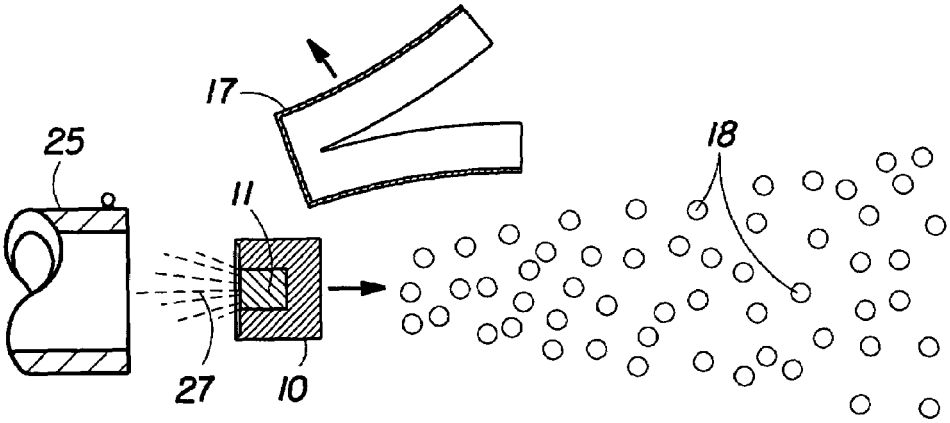

In FIG. 7C, after leaving the shotgun barrel 25, the shot cup 17 has flipped out of the way of the scattering shot pellets 18. The ballistic tracer platform 10, carrying the tracer element 11 which emits visible luminescence 27, is located in the center of the pattern of shot pellets 18.

Figure 7D:
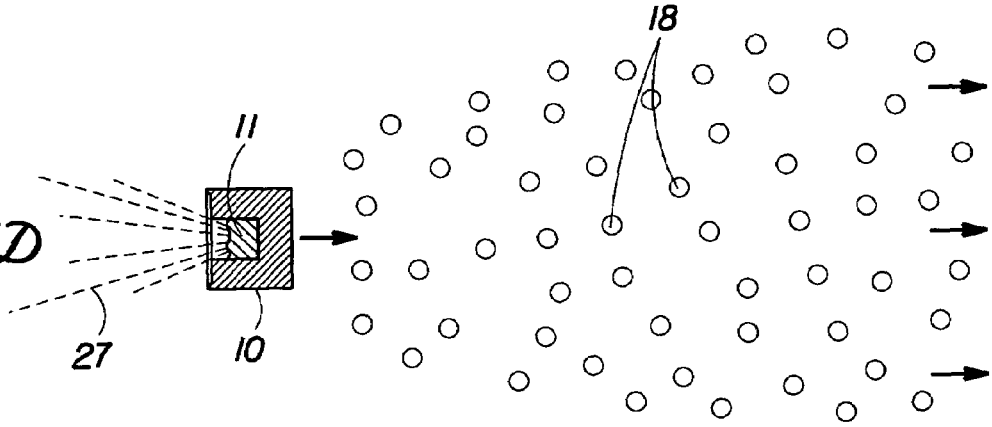

As shown in FIG. 7D, the ballistic tracer platform 10, carrying the tracer element 11 which continues to emit luminescence 27, remains centered behind the pattern of shot pellets 18 as they travel and expand.

Figure 8:
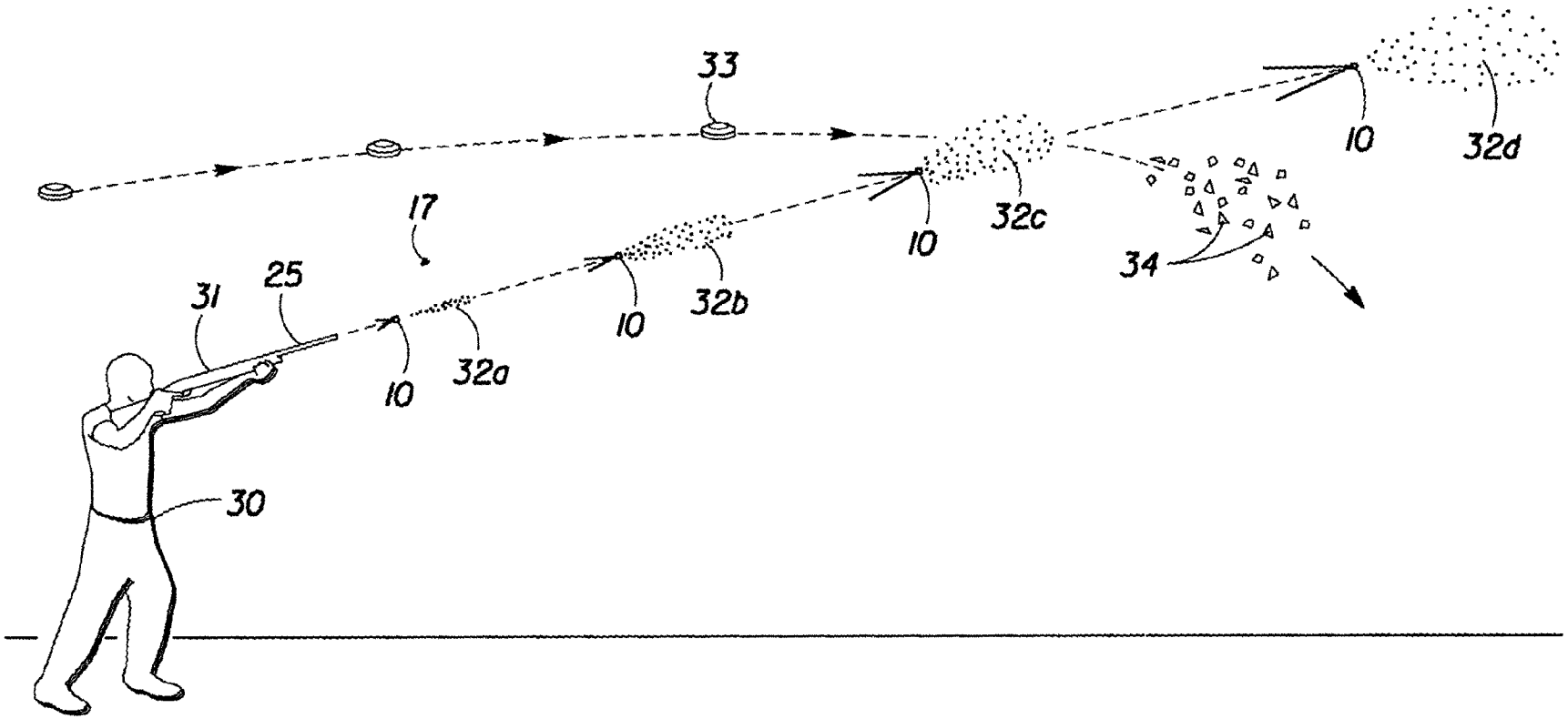
FIG. 8 is a representational view of a shooter using the ballistic tracer platform of the present invention while shooting at a clay target.

FIG. 8 shows a shooter 30 using the ballistic tracer platform 10 of the present invention. The shooter has loaded his shotgun 31 as he would load any other ammunition. The shooter has aimed at the clay target 33 and has fired. The ballistic tracer platform 10 has left the shotgun barrel 25, and follows the shot string 32A, 32B, 32C, 32D as the pattern expands, remaining centered with the pattern of shot pellets in the shot string 32. (The shot cup 17 has flipped out of the way.) If the shooter 30 hits the clay target 33, it breaks into pieces 34. If he misses the clay target 33, the shooter 30 would correct his lead or aiming point, according to the relative position of the ballistic tracer platform 10 to the clay target 33. For example, if the ballistic tracer platform 10 is behind the clay target 33 and the clay target 33 is missed, the shooter 30 would need to aim further ahead of the clay target 33 in order to break it. In some cases the shooter 30 can benefit from having a shooting partner who would help confirm the position of the ballistic tracer platform 10 relative to the missed target 33.

Although the description contains much specificity, these should not be construed as limiting the scope of the invention, but merely providing illustrations of some of the presently preferred embodiments of this invention. Thus the scope of the invention should be determined by the appended claims and their legal equivalents, rather than be the examples given.

We claim:

1. A cylindrical ballistic tracer platform for holding and carrying an integrated inseparable tracer element having a bottom, the tracer platform designed for use with a shotgun shell having a bore, a shot holder and propellant, the tracer platform to be positioned within the shotgun shell to at least substantially fill the portion of the bore between the shot holder and the propellant, the tracer platform having a closed nose to be positioned proximate to the shot holder and a bottom to be positioned proximate to the propellant and a coaxial cavity formed therein, said coaxial cavity being coaxial to said bore and extending from the bottom upwards to a portion of said tracer platform intermediate to the nose and bottom of the tracer platform, the tracer element being disposed away from the shot holder, the tracer element entirely filling said coaxial cavity having a lower end at the bottom of the tracer platform, the bottom of the tracer platform and the bottom of the tracer element being shaped to leave a generally concave cavity which provides an open space between the bottom of the tracer platform and the propellant and acts as a gas seal upon ignition of the propellant.

2. The ballistic tracer platform of claim 1 wherein the tracer element comprises a cylindrical housing containing pyrotechnic material susceptible to ignition upon burning of the propellant.

3. The ballistic tracer platform of claim 2 wherein the housing of the tracer element further contains a fire-suppressing agent.

4. The ballistic tracer platform of claim 1 wherein the tracer element is selected from the group consisting of electrical material, reflective material, chemiluminescent material, and pyrotechnic material.

5. The ballistic tracer platform of claim 1 wherein the tracer platform has a ballistic coefficient equivalent to a shot pellet's ballistic coefficient.

6. The ballistic tracer platform of claim 5 wherein the tracer platform is made from one or more of the materials selected from the group consisting of aluminum, brass, lead, neoprene, nylon, polyethylene, polyurethane, rubber, steel, polytetrafluoroethylene, and titanium.

7. The ballistic tracer platform of claim 1 wherein the tracer platform further has a diameter in the range of 0.2 inches to 1.25 inches.

8. The ballistic tracer platform of claim 1 wherein the nose of the tracer platform has a shape selected from the group consisting of flat, conical, and spherical.

9. The ballistic tracer platform of claim 1 wherein the tracer platform has formed therein symmetrical cavities for holding weights for the adjustment of the tracer platform's weight and flight characteristics.

10. The ballistic tracer platform of claim 1 wherein the tracer platform has an outer surface with grooves formed therein.

11. The ballistic tracer platform of claim 1 wherein the tracer platform has an outer surface with symmetrically-positioned fins attached thereto.

12. The ballistic tracer platform of claim 1 wherein the tracer platform has an outer surface with orifices formed therein.

13. The ballistic tracer platform of claim 1 wherein the tracer element is made inseparable from the ballistic tracer platform by means selected from gluing, interference fitting, and injection molding.

14. A shotgun shell with a tracer for making shot projectiles visible to a shooter comprising:

(a) a hollow shotgun shell having a bore, a lower end and an upper end;

(b) a base with primer for ignition located inside the lower end of the shotgun shell;

(c) propellant positioned proximate to the primer;

(d) a shot holder holding shot pellets located inside the upper end of the shotgun shell;

(e) a cylindrical ballistic tracer platform for holding and carrying an integrated inseparable tracer element having a bottom, the tracer platform being positioned inside the shotgun shell to at least substantially fill the portion of the bore between the shot holder and the propellant, the tracer platform having a closed nose and a bottom and a coaxial cavity formed therein, said coaxial cavity being coaxial to said bore and extending from the bottom upwards to a portion of said tracer platform intermediate to the nose and bottom of the tracer platform, the tracer element entirely filling said coaxial cavity having a lower end at the bottom of the tracer platform, the bottom of the tracer platform and the bottom of the tracer element being shaped to leave a generally concave cavity which provides an open space between the bottom of the tracer platform and the propellant and acts as a gas seal upon ignition of the propellant.

15. The shotgun shell of claim 14 wherein the tracer element comprises a cylindrical housing containing pyrotechnic material susceptible to ignition upon burning of the propellant.

16. The shotgun shell of claim 14 wherein the housing of the tracer element further contains a fire-suppressing agent.

17. The shotgun shell of claim 14 wherein the tracer element is selected from the group consisting of electrical material, reflective material, chemiluminescent material, and pyrotechnic material.

18. The shotgun shell of claim 14 wherein the ballistic tracer platform has a ballistic coefficient equivalent to a shot pellet's ballistic coefficient.

19. The shotgun shell of claim 18 wherein the ballistic tracer platform is made from one or more of the materials selected from the group consisting of aluminum, brass, lead, neoprene, nylon, polyethylene, polyurethane, rubber, steel, polytetrafluoroethylene, and titanium.

20. The shotgun shell of claim 14 wherein the ballistic tracer platform further has a diameter in the range of 0.2 inches to 1.25 inches.

21. The shotgun shell of claim 14 wherein the nose of the ballistic tracer platform has a shape selected from the group consisting of flat, conical, and spherical.

22. The shotgun shell of claim 14 wherein the ballistic tracer platform has formed therein symmetrical cavities for holding weights for the adjustment of the tracer platform's weight and flight characteristics.

23. The shotgun shell of claim 14 wherein the ballistic tracer platform has an outer surface with grooves formed therein.

24. The shotgun shell of claim 14 wherein the ballistic tracer platform has an outer surface with symmetrically-positioned fins attached thereto.

25. The shotgun shell of claim 14 wherein the ballistic tracer platform has an outer surface with orifices formed therein.

26. The shotgun shell of claim 14 wherein the tracer element is made inseparable from the ballistic tracer platform by means selected from gluing, interference fitting, and injection molding.

* * * * *